US005533241A

United States Patent [19]

McConnell

[11] Patent Number: 5,533,241

[45] Date of Patent: Jul. 9, 1996

[54] FUNERAL BIERS WITH EXCHANGEABLE PICTURES AND ILLUMINATION DEVICES

[76] Inventor: Jerry M. McConnell, 260 Cherry St., Bluefield, W. Va. 24701

[21] Appl. No.: 209,238

[22] Filed: Mar. 14, 1994

[51] Int. Cl.[6] ..... A61G 17/00

[52] U.S. Cl. ..... 27/27; 40/714; 312/223.5; 362/154

[58] Field of Search ..... 27/16, 19, 35, 27/27; 40/124.5, 152.5; 312/223.5; 362/154, 145, 133

[56] References Cited

U.S. PATENT DOCUMENTS

| | | | |
|---|---|---|---|
| 638,075 | 11/1899 | Jean | 27/27 |
| 822,106 | 5/1906 | Fancher | 40/124.5 |
| 878,985 | 2/1908 | Montross | 27/27 |
| 953,053 | 3/1910 | McMullen | 40/124.5 |
| 2,674,102 | 4/1954 | Stile | 27/27 |
| 2,703,743 | 3/1955 | Harwood | 312/223.5 |
| 2,817,138 | 12/1957 | Merz | 27/27 |
| 2,916,841 | 12/1959 | Denis | 40/152.2 |
| 4,017,947 | 4/1977 | Acton | 27/27 |
| 4,790,088 | 12/1988 | Morvant | 40/124.5 |
| 4,962,574 | 10/1990 | Estes | 27/19 X |
| 5,165,783 | 11/1992 | Barron | 40/152.2 X |
| 5,313,724 | 5/1994 | Warner | 40/152.2 |

FOREIGN PATENT DOCUMENTS

| | | | |
|---|---|---|---|
| 678291 | 1/1964 | Canada | 27/27 |
| 898661 | 6/1962 | Ireland | 27/19 |

*Primary Examiner*—Carl D. Friedman
*Assistant Examiner*—Beth A. Aubrey

[57] ABSTRACT

A funeral bier with exchangeable pictures and illumination comprising a frame structure having shortened rectangular side walls parallel with each other, elongated rectangular rear and front walls parallel with each other secured at their lateral edges to the lateral edges of the side walls in a rectangular configuration, a bottom wall in a rectangular configuration secured at its edges to the lower edges of the side walls and a lid in a rectangular configuration pivotally secured to the upper edge of the rear wall for providing access to the interior of the frame structure; a picture frame removably secured to the exterior face of the front wall with a transparent window supported therein adapted to receive a picture between the window and the front wall, the frame having a horizontal lower support and spaced vertical lateral supports; and an illumination device positioned between the upper edges of the side structures and parallel with and above the lower structure for illuminating the window, the illumination device also having a shield and electrical components including an on/off switch for the bulb.

1 Claim, 3 Drawing Sheets

10
26
68
20
28
64
76
82
18
80
82
12
84
76
72
24
88

FUNERAL BIERS WITH EXCHANGEABLE PICTURES AND ILLUMINATION DEVICES

BACKGROUND OF THE INVENTION

1. Field of the Invention

The present invention relates to funeral biers with exchangeable pictures and illumination devices and more particularly pertains to providing an exchangeable picture on the front wall of a funeral bier with an illumination device thereabove and other features for extended utility.

2. Description of the Prior Art

The use of funeral biers is known in the prior art. More specifically, funeral biers heretofore devised and utilized for the purpose of supporting a casket are known to consist basically of familiar, expected, and obvious structural configurations, notwithstanding the myriad of designs encompassed by the crowded prior art which has been developed for the fulfillment of countless objectives and requirements.

The prior art discloses a large number of funeral biers. By way of example, U.S. Pat. No. 257,183 to Bruce discloses a casket bier.

U.S. Pat. No. 3,692,267 to Kronas discloses a positional adjustment device for casket beds.

U.S. Pat. No. 4,017,947 to Acton discloses a casket and casket support.

U.S. Pat. No. 4,153,285 to Sparling discloses a carrying device for a generally rectilinear article.

U.S. Pat. No. 4,315,354 to Behrendt discloses a casket carrier.

In this respect, funeral biers with exchangeable pictures and illumination devices according to the present invention substantially depart from the conventional concepts and designs of the prior art, and in doing so provide an apparatus primarily developed for the purpose of providing an exchangeable picture on the front wall of a funeral bier with an illumination device thereabove and other features for extended utility.

Therefore, it can be appreciated that there exists a continuing need for new and improved funeral biers with exchangeable pictures and illumination devices which can be used for providing an exchangeable picture on the front wall of a funeral bier with an illumination device thereabove and other features for extended utility. In this regard, the present invention substantially fulfills this need.

SUMMARY OF THE INVENTION

In view of the foregoing disadvantages inherent in the known types of funeral biers now present in the prior art, the present invention provides improved funeral biers with exchangeable pictures and illumination devices. As such, the general purpose of the present invention, which will be described subsequently in greater detail, is to provide new and improved funeral biers with exchangeable pictures and illumination devices and methods which have all the advantages of the prior art and none of the disadvantages.

To attain this, the present invention essentially comprises a new and improved funeral bier with exchangeable pictures and illumination comprising, in combination, a frame structure having shortened rectangular side walls parallel with each other, elongated rectangular rear and front walls parallel with each other secured at their lateral edges to the lateral edges of the side walls in a rectangular configuration, a bottom wall in a rectangular configuration secured at its edges to the lower edges of the side walls and a lid in a rectangular configuration pivotally secured to the upper edge of the rear wall for providing access to the interior of the frame structure; a picture frame removably secured to the exterior face of the front wall with a transparent window supported therein adapted to receive a picture between the window and the front wall, the frame having a horizontal lower support and spaced vertical lateral supports; an illumination device in the form of a fluorescent bulb positioned between the upper edges of the side structures and parallel with and above the lower structure for illuminating the window, the illumination device also including a shield and supporting electrical components and an on/off switch for the bulb; a plurality of raised gasket stops on each side of the lid to preclude lateral shifting of a casket placed on the lid; decorative means secured to the exterior surface of the front wall on opposite sides of the picture, the decorative means in the forms of metal flowers; carpeting secured to the side walls at locations remote from the pictures; a railing for carrying purposes located horizontally along the upper extent of the side, rear and front walls; a caster located beneath each corner of the bottom wall for facilitating the shifting thereof; a fluorescent light secured beneath the lower surface of the bottom wall to achieve a floating effect when illuminated.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved funeral biers with exchangeable pictures and illumination devices which have all the advantages of the prior art funeral biers and none of the disadvantages.

It is another object of the present invention to provide new and improved funeral biers with exchangeable pictures and illumination devices which may be easily and efficiently manufactured and marketed.

It is a further object of the present invention to provide new and improved funeral biers with exchangeable pictures and illumination devices which are of a durable and reliable construction.

An even further object of the present invention is to provide new and improved funeral biers with exchangeable pictures and illumination devices which are susceptible of a low cost of manufacture with regard to both materials and labor, and which accordingly are then susceptible of low prices of sale to the consuming public, thereby making such funeral biers with exchangeable pictures and illumination devices economically available to the buying public.

Still yet another object of the present invention is to provide new and improved funeral biers with exchangeable pictures and illumination devices which provide in the apparatuses and methods of the prior art some of the advantages thereof, while simultaneously overcoming some of the disadvantages normally associated therewith.

Even still another object of the present invention is to exchange pictures on the front wall of a funeral bier with an illumination device thereabove and other features for extended utility.

Lastly, it is an object of the present invention to provide a funeral bier with exchangeable pictures and illumination comprising a frame structure having shortened rectangular side walls parallel with each other, elongated rectangular rear and front walls parallel with each other secured at their lateral edges to the lateral edges of the side walls in a rectangular configuration, a bottom wall in a rectangular configuration secured at its edges to the lower edges of the side walls and a lid in a rectangular configuration pivotally secured to the upper edge of the rear wall for providing access to the interior of the frame structure; a picture frame removably secured to the exterior face of the front wall with a transparent window supported therein adapted to receive a picture between the window and the front wall, the frame having a horizontal lower support and spaced vertical lateral supports; and an illumination device positioned between the upper edges of the side structures and parallel with and above the lower structure for illuminating the window, the illumination device also having a shield and electrical components including an on/off switch for the bulb.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
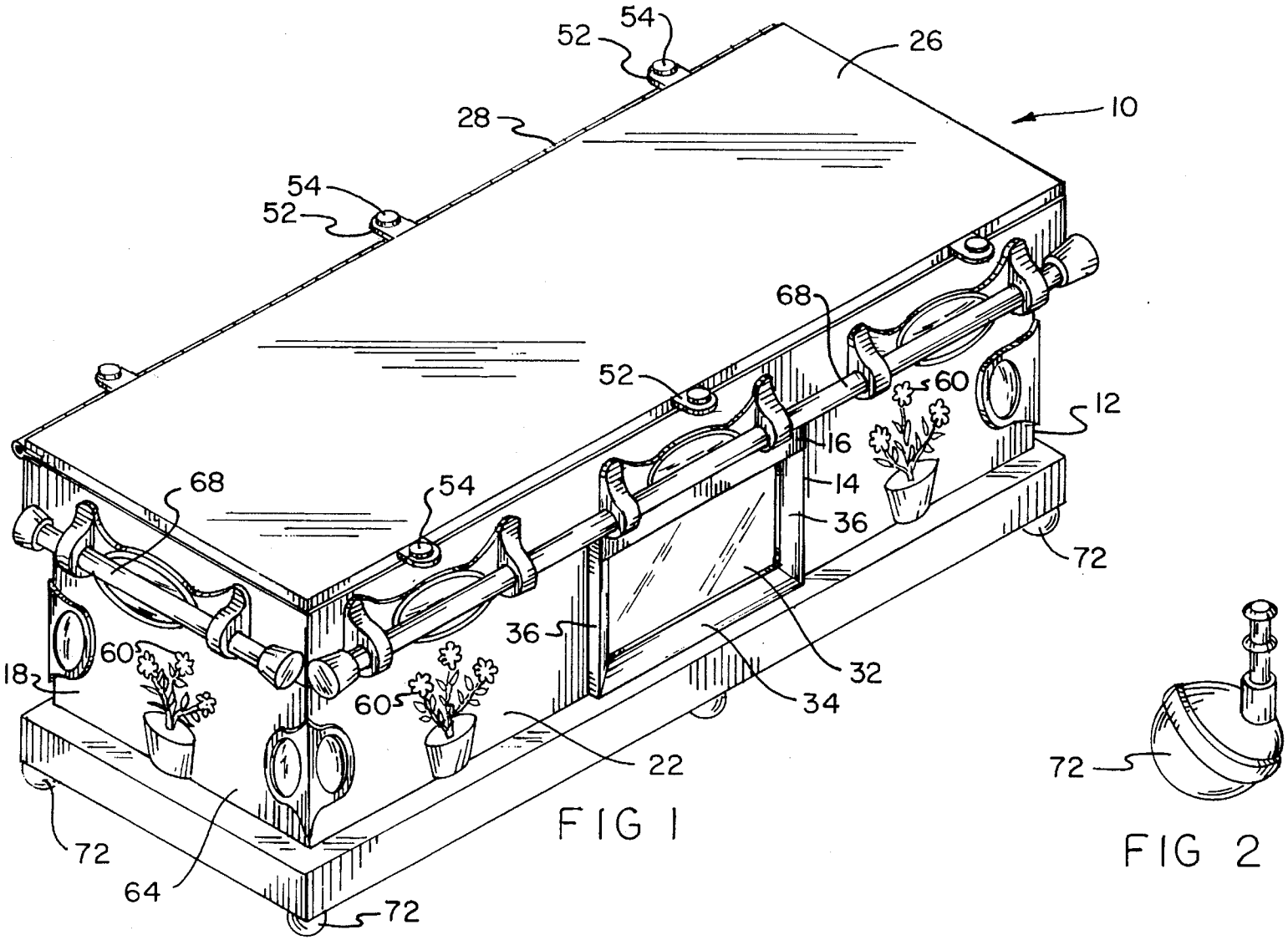
FIG. 1 is a perspective illustration of the preferred embodiment of the funeral bier with exchangeable pictures and illumination devices constructed in accordance with the principles of the present invention.
FIG. 2 is a perspective view of one of the castors employed with the bier of FIG. 1.
Figure 3:
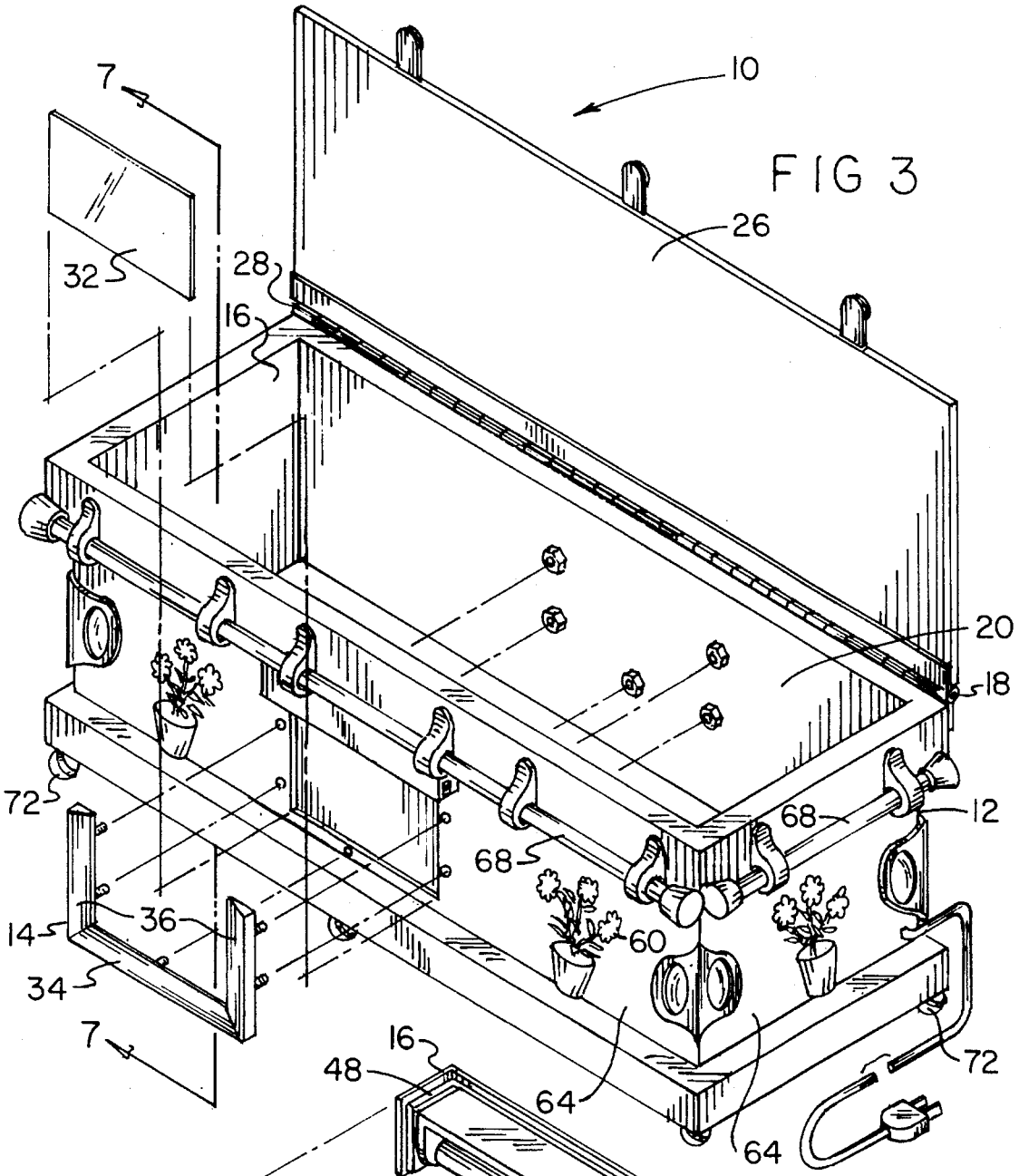
FIG. 3 is an exploded perspective view of the bier shown in FIG. 1.
Figure 4:
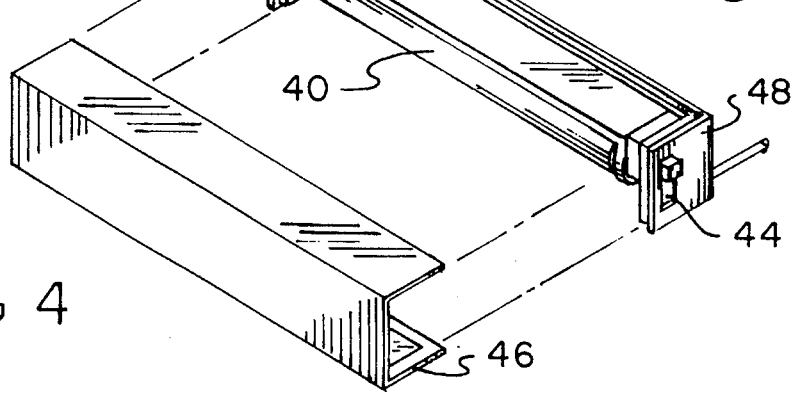
FIG. 4 is an exploded perspective view of the lighting assembly shown in FIGS. 1 and 2.

With reference now to the drawings, and in particular to FIG. 1 thereof, the preferred embodiment of the new and improved funeral biers with exchangeable pictures and illumination devices embodying the principles and concepts of the present invention and generally designated by the reference numeral 10 will be described.

Specifically, the funeral bier of the present invention is composed of three major components, such components are the frame structure 12, the picture frame 14 and the illumination device 16 for the picture frame. Together these components function for their intended purposes and objectives.

More specifically, the frame structure is fabricated of shortened rectangular side walls 18. The side walls extend vertically and are parallel with each other. Also included is a rear and front wall 20 and 22. Each is of a rectangular configuration secured at their lateral edges to the lateral edges of the side walls 18. Together the walls form a rectangular configuration. A bottom wall 24 is also of a rectangular configuration. It is secured at its peripheral edges to the lower edges of the other walls to form a container.

A lid 26, also in a configuration generally corresponding to the bottom wall 24 is secured to the upper edge of the rear wall by a hinge 28. This provides a pivotal securement for allowing access to the interior of the frame structure.

The second component of the bier is the picture frame 14. Such picture frame is secured to the exterior face of the front wall 22. The picture frame has a transparent window 32 supported therein. It is adapted to receive, between the window 32 and the front wall 22, a pre-selected picture. Support for the window is through a horizontal lower support 34 and spaced vertical lateral supports 36. Such supports generally form the lower and side components of a picture frame. The lack of support across the top allows for the ready removal and insertion of the window and a preselected picture. Bolts on the supports extend through holes in the front wall and couple with nuts for the ready removal thereof.

The third major component of the bier is the illumination device 16. The illumination device is positioned between the upper edges of the lateral supports 36. It extends parallel with, and above, the lateral and lower supports. Also included is a fluorescent, preferably neon, bulb 40 and associated electrical components 44, including an on/off switch, for providing the necessary illumination of the picture behind the window. A front shield 46 in combination with the side shields of the bulb support 48 restrict illumination from the bulb 40 in a downward direction. As such, the bulb is properly illuminated.

Further features of the invention for extended utility include a plurality of casket stops 52. Such casket stops are upwardly extending projections 54 on outwardly extending rods which are located beyond the periphery of the lid. Such casket stops preclude inadvertent shifting of a casket located thereon for greater safety and security.

An additional feature of the invention is decorative means 60 in the nature of flowers and flower pots. Such decorative means are preferably permanently secured to the front wall 20 of the bier on opposite sides of the window and picture. They may also be utilized on the side walls 18. The purpose of such decorative means are principally for aesthetic purposes.

A further feature for aesthetic purposes includes the carpeting 64. Such carpeting is preferably provided on all faces of the bier including all of the side, rear and front walls. Such carpeting is preferably located in direct contact with the material of such walls. The decorative means 60 are secured thereover.

As is conventional, supplemental supports in the nature of railings 68 are located on all four sides of the bier. Such railings are secured to the upper extents of the side walls, rear and front walls. The railings assist in transporting the bier from one location to another.

Figure 5:
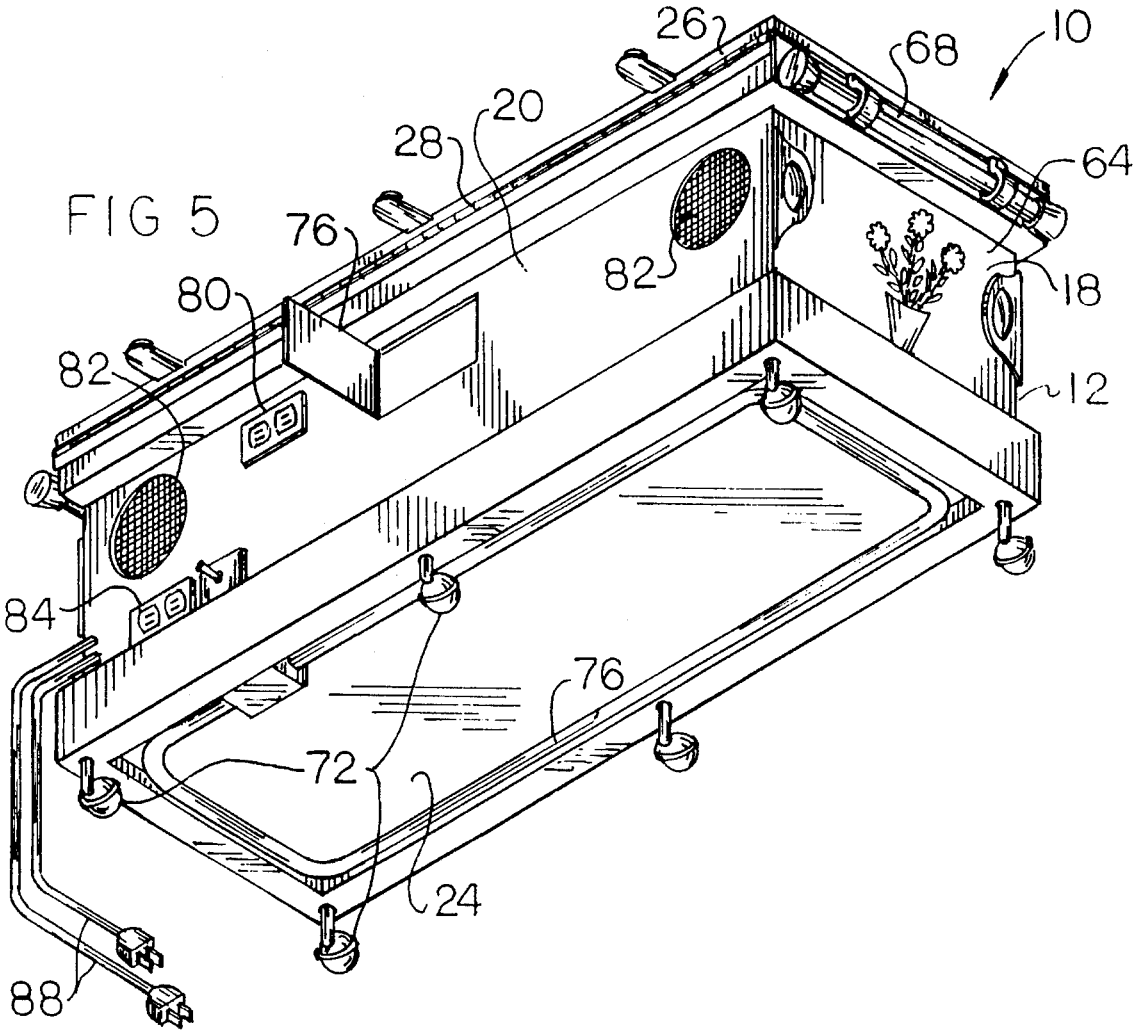
FIG. 5 is a perspective view of the bier of the prior Figures taken from the rear, bottom and one side.

As can be seen in FIG. 5, a central door 76 is provided. Such door is hinged at one side and is utilized to facilitate the changing of the light bulb for the picture in the event that the bier is occupied. Thereadjacent is an upper electrical receptacle 80 available for a plurality of purposes. Other features on the back of the bier to increase its utility include speakers 82 in the event that music is to be provided by a sound system, a lower electrical receptacle 84 as for cosmetic floor lamps or other appliances, and electrical lines 88 with plugs for bringing electrical power to the bier.

Movement of the bier is also facilitated by the use of casters 72. One such caster is located beneath each corner of the bottom wall in order to facilitate the pushing of the bier from one location to another with minimum effort.

Biers are used for holding coffins in funeral homes. Most biers are rather dull looking and even depressing. Because the passing away of a loved one is such a painful and highly emotional experience, it is important to lift the spirits of the families who are going through this difficult ordeal.

The present invention is a uniquely designed bier. It has a number of outstanding features that are not found on conventional units. The present invention provides comfort and gives reassurance to the family members that their loved one is resting peacefully in eternal happiness. In the center of the bier is a picture of Jesus praying in the garden, or a similar scene is depicted. Illumination ensures that the picture is prominently displayed. There are also metal flower arrangements on both sides of the picture. Other features include three casket stops on each side of the bier, a beautiful burgundy carpet covering, and a receptacle for the switch. In addition, the present invention has a railing for easy lifting.

The present invention is made from a combination of durable materials. It is very attractive and is a significant improvement over a conventional bier.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved funeral bier with exchangeable pictures and illumination, the bier being utilized to support a casket thereupon, the apparatus comprising, in combination:

a frame structure having shortened rectangular side walls parallel with each other, each side wall having an upper extent and a lower extent and lateral edges, elongated rectangular rear and front walls parallel with each other, the rear and front walls having upper extents, lower extents, and lateral edges, the rear and front walls being secured at their lateral edges to the lateral edges of the side walls in a rectangular configuration, a bottom wall in a rectangular configuration having sides, an upper extent, a lower extent, corners, a top, a bottom and lateral edges secured at its edges to the lower edges of the side walls and a planar lid having four sides in a rectangular configuration to permit a casket to be supported thereupon, the lid being pivotally secured to the upper edge of the rear wall for providing access to the interior of the frame structure;

a picture frame removably secured to the exterior face of the front wall with a transparent window supported therein adapted to receive a picture between the window and the front wall, the frame having a horizontal lower support, spaced vertical lateral supports, and the lack of a support across the top allowing for the ready removal of the window and a picture;

an illumination device having two outwardly extending bulb supports comprising a fluorescent bulb positioned between the upper edges of the vertical lateral supports of the picture frame and parallel with the horizontal lower support of the picture frame, the illumination device also including a front and side shield and supporting electrical components, the front shield being formed in an L-shaped configuration and an on/off switch for the bulb;

a plurality of raised casket stops comprising outwardly extending rods with upwardly extending projections on the outwardly extending rods on each side of the lid to preclude lateral shifting of a casket placed on the lid;

decorative means secured to the exterior surface of the front wall on opposite sides of the picture, the decorative means being in the form of metal flowers and flowerpots;

carpeting secured to the rear, front and side walls;

a railing for carrying purposes located horizontally along the upper extents of the side, rear and front walls;

six spherically-shaped casters located beneath each corner and along the sides of the bottom wall for facilitating the shifting thereof; and a door on the rear wall to facilitate entry into the interior of the bier.

* * * * *